US011832649B2

(12) United States Patent
Huang et al.

(10) Patent No.: US 11,832,649 B2
(45) Date of Patent: Dec. 5, 2023

(54) ATOMIZER OF ELECTRONIC CIGARETTE THAT IS SIMPLE IN ASSEMBLY, SAFE AND RELIABLE, AND EFFECTIVELY INCREASE THE SERVICE LIFE

(71) Applicant: SHENZHEN YOUME INFORMATION TECHNOLOGY CO., LTD, Guangdong (CN)

(72) Inventors: Furong Huang, Shenzhen (CN); Bin Liu, Shenzhen (CN); Yufei Tu, Shenzhen (CN)

(73) Assignee: SHENZHEN YOUME INFORMATION TECHNOLOGY CO., LTD, Shenzhen (CN)

( * ) Notice: Subject to any disclaimer, the term of this patent is extended or adjusted under 35 U.S.C. 154(b) by 704 days.

(21) Appl. No.: 16/960,490

(22) PCT Filed: Dec. 30, 2019

(86) PCT No.: PCT/CN2019/129777
§ 371 (c)(1),
(2) Date: Jul. 7, 2020

(87) PCT Pub. No.: WO2020/228343
PCT Pub. Date: Nov. 19, 2020

(65) Prior Publication Data

US 2021/0100287 A1 Apr. 8, 2021

(30) Foreign Application Priority Data

May 15, 2019 (CN) ..... 201910403537.5

(51) Int. Cl.
*A24F 40/44* (2020.01)
*A24F 40/46* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01);
(Continued)

(58) Field of Classification Search
CPC ..... A24F 40/44; A24F 40/46; A24F 40/10; A24F 40/42; A24F 40/485
See application file for complete search history.

(56) References Cited

U.S. PATENT DOCUMENTS 11,297,881 B2 * 4/2022 Qiu ..... A24F 40/48
11,382,354 B2 * 7/2022 Chen ..... A24F 40/10
2014/0376895 A1 12/2014 Han

FOREIGN PATENT DOCUMENTS

CN 105747278 A 7/2016
CN 205658373 U 10/2016
(Continued)

OTHER PUBLICATIONS

Patent Cooperation Treaty: International Search Report for PCT/CN2019/129777; dated Mar. 26, 2020; 11 pages.

*Primary Examiner* — Hae Moon Hyeon

(57) ABSTRACT

An atomizer includes a housing, a base and an atomization component. The housing includes a mouthpiece end and an opening end, the base is plugged into the opening end of the housing, an electronic cigarette liquid (e-liquid) storage chamber and an airflow channel are provided inside the housing; wherein the atomization component includes a porous heating element, the porous heating element includes a porous element and a heating element provided in the porous element, the porous element is provided in the airflow channel, and the porous element includes a porous body and a porous boss protruding from the porous body and extending radially along the porous body, the porous boss
(Continued)

traverses the airflow channel and is in communication with the e-liquid storage chamber.

19 Claims, 6 Drawing Sheets

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/50*** | (2020.01) |
| ***H05B 3/10*** | (2006.01) |

(52) U.S. Cl.
CPC ..... *A24F 40/485* (2020.01); *A24F 40/50* (2020.01); *H05B 3/10* (2013.01); *H05B 2203/021* (2013.01)

(56) References Cited

FOREIGN PATENT DOCUMENTS

| | | | | | |
|---|---|---|---|---|---|
| CN | 206390306 | U | | 8/2017 | |
| CN | 107874323 | A | | 4/2018 | |
| CN | 109247620 | A | | 1/2019 | |
| CN | 109700077 | A | | 5/2019 | |
| CN | 110074464 | A | | 8/2019 | |
| CN | 112790432 | A | * | 5/2021 | ..... A24F 40/10 |

* cited by examiner

ATOMIZER OF ELECTRONIC CIGARETTE THAT IS SIMPLE IN ASSEMBLY, SAFE AND RELIABLE, AND EFFECTIVELY INCREASE THE SERVICE LIFE

CROSS-REFERENCE TO RELATED APPLICATION

This application claims priority of the Chinese Patent Application No. 201910403537.5, entitled "Atomizer and Electronic Cigarette", filed on May 15, 2019, the entire content of which is incorporated herein by reference.

TECHNICAL FIELD

The present disclosure relates to an alternative to cigarettes, and particularly to an atomizer and an electronic cigarette.

BACKGROUND

An electronic cigarette has the same appearance, smoke, taste, and feel as a cigarette. As tobacco smoking can cause toxic ingredients in the tobacco to enter a user's body along with smoking, which can adversely affect the health of the user and the people around the user. Accordingly, the electronic cigarette, which is mainly used for quitting smoking and replacing cigarettes, has been rapidly popularized.

The existing electronic cigarette includes a battery host and an atomizer. The electronic cigarette can be powered on via an air pressure switch, such that a heating coil in the atomizer is heated to atomize an electronic cigarette liquid (e-liquid) and form smoke steam for the user to smoke. Specifically, an e-liquid storage chamber for storing the e-liquid and a channel for airflow and smoke to pass through are provided inside the atomizer. An e-liquid guiding hole is provided between the e-liquid storage chamber and the channel. The e-liquid in the e-liquid storage chamber is exported through the e-liquid guiding hole to an atomization component in the atomizer. Specifically, an e-liquid guiding cotton element is provided to stick into the e-liquid storage chamber through the e-liquid guiding hole and come into contact with the e-liquid. Alternatively, a ceramic heating element is provided to generate heat. The ceramic heating element is covered with cotton before matching the e-liquid guiding hole, such that the e-liquid in the e-liquid storage chamber flows through the e-liquid guiding hole to the cotton and then is locked and heated by the ceramic heating element. When the electronic cigarette is smoked, the atomization component in the atomizer is powered on to generate high-temperature atomized the e-liquid. The high-temperature atomized e-liquid is formed into droplets and is remained in the atomizer when the high-temperature atomized e-liquid is cooled or is not completely smoked. The e-liquid exported through the e-liquid guiding hole may be adsorbed to wall surfaces of the atomization component and the atomization chamber. When there are more droplets, the droplets may be mixed with the e-liquid adsorbed to the wall surfaces of the atomization component and the atomization chamber to form liquor condensate. When a user smokes, the liquor condensate mixed with the droplets and the e-liquids may be smoked, which affects the taste and experience of smoking. In addition, the liquor condensate may penetrate into the battery host through a base, and corrode a circuit board, which causes a short circuit of the circuit board, and affect a service life of the electronic cigarette.

SUMMARY

Based on this, it is necessary to provide an atomizer and an electronic cigarette which are good in taste, good in user experience, simple in assembly, safe and reliable, and can effectively improve the service life.

An atomizer includes a housing, a base and an atomization component; the housing includes a mouthpiece end and an opening end, the base is plugged into the opening end of the housing, an electronic cigarette liquid (e-liquid) storage chamber and an airflow channel are provided inside the housing; the atomization component includes a porous heating element, the porous heating element includes a porous element and a heating element provided in the porous element, the porous element is provided in the airflow channel, and the porous element includes a porous body and a porous boss protruding from the porous body and extending radially along the porous body, the porous boss traverses the airflow channel and is in communication with the c-liquid storage chamber.

In an embodiment, the porous body has a hollow chamber structure with one end open and the other end closed, the closed end is adjacent to the base, a side wall of the porous body is provided with a through hole.

In an embodiment, an outer wall of the porous body is partially fitted to an inner wall of the airflow channel, a gap is preset between the through hole and the inner wall of the airflow channel.

In an embodiment, the porous body and the porous boss are intersected, and an axial cross section of the porous element is T-shaped, cross-shaped, L-shaped, or Y-shaped.

In an embodiment, a position relationship between the heating element and the porous body is any one of the following:

(1) the heating element is attached to a hollow inner wall of the porous body, and an electrical contact portion of the heating element protrudes from a closed end of the porous body;

(2) the heating element is a printed circuit printed on an outer wall of the porous body, and the printed circuit is electrically connected to an electrode column of the atomizer;

(3) the heating element is embedded in the porous body, and the electrical contact portion of the heating element protrudes from the closed end of the porous body.

In an embodiment, the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

In an embodiment, the airflow channel includes an atomization chamber and a smoke channel which are in communication with each other, the e-liquid guiding hole is provided on a wall surface of the atomization chamber, and the atomization component is plugged into the e-liquid guiding hole via the porous boss and is fixed in the atomization chamber; the atomization chamber is in communication with an air intake hole of the atomizer, and the smoke channel is in communication with the mouthpiece of the atomizer.

In an embodiment, the base includes a supporting seat and a sealing seat, the supporting seat is sheathed in the sealing seat, and the atomization chamber is provided between the supporting seat and the sealing seat, the atomization chamber and the smoke channel run through the sealing seat and are in communication with each other.

In an embodiment, the air intake hole of the atomizer is provided in the base, the air intake hole is in communication with the airflow channel, and one side of the base adjacent to the airflow channel is provided with a weir, the air intake hole is surrounded by the weir.

In an embodiment, the air intake hole of the atomizer is provided in the housing, the air intake hole is in communication with the airflow channel.

In an embodiment, the base is provided with an e-liquid injection hole and an e-liquid injection plug, the e-liquid injection plug is adapted to the e-liquid injection hole, and the e-liquid injection hole is in communication with the e-liquid storage chamber.

An electronic cigarette includes a host and the atomizer, the atomizer is electrically conductive with the host, and the atomizer is plugged into the host.

In an embodiment, the host includes a battery, a main control board and an air pressure switch; the battery, the main control board and the air pressure switch are electrically connected with each other; the air pressure switch is in communication with the airflow channel, and the main control board is provided with a conductive column electrically connected to the atomizer.

Details of one or more embodiments of the present disclosure are set forth in the following drawings and description. Other features, objectives and advantages of the disclosure will become apparent from the specification, drawings and claims.

BRIEF DESCRIPTION OF THE DRAWINGS

In order to describe the technical solutions in the embodiments of the present disclosure or in the prior art more clearly, accompanying drawings required for describing the embodiments or the prior art are introduced briefly below. Apparently, the accompanying drawings in the following description are only some exemplary embodiments of the present disclosure, and persons of ordinary skill in the art can obtain other drawings according to the accompanying drawings without any creative work.

DETAILED DESCRIPTION OF THE EMBODIMENTS

In order to facilitate understanding of the disclosure, the disclosure will be described more comprehensively below with reference to the accompanying drawings. Preferred embodiments of the present disclosure are shown in the accompanying drawings. However, the present disclosure can be implemented in many different forms and is not limited to the embodiments described herein. Rather, the objective of these embodiments is to provide more thorough understanding of the present disclosure.

It should be noted that when an element is referred to as being "fixed" to another element, it can be directly on the other element or there may be an intermediate element. When an element is considered to be "connected" to another element, the element can be directly connected to the other element or there may be an intermediate element at the same time. The terms "inside", "outside", "left", "right" and the like used herein are for illustrative purposes only and are not meant to be the only embodiments.

Figure 1:
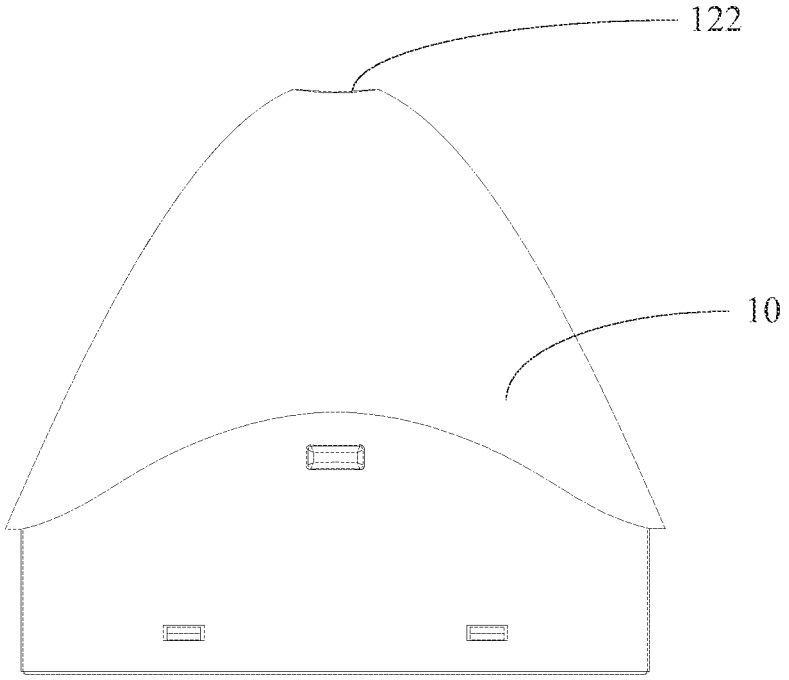
FIG. 1 is a schematic structure diagram of an atomizer according to an embodiment.

Referring to FIG. 1, which shows an overall structure diagram of an atomizer 10 according to an embodiment. The atomizer 10 is a smoke generating device of an electronic cigarette, and is configured to cooperate with a host 20 of the electronic cigarette. After being powered on, the atomizer 10 can heat and atomize an e-liquid to form smoke for a user to take.

Figure 2:
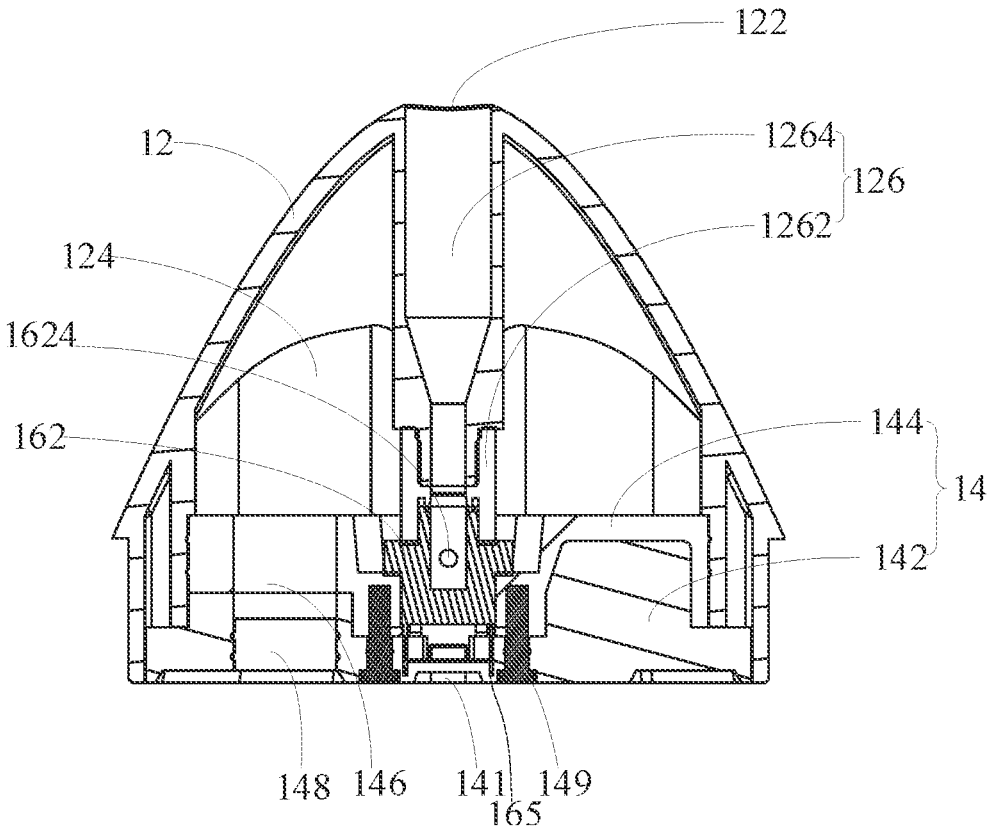
FIG. 2 is a cross-sectional view of the atomizer in FIG. 1.
Figure 3:
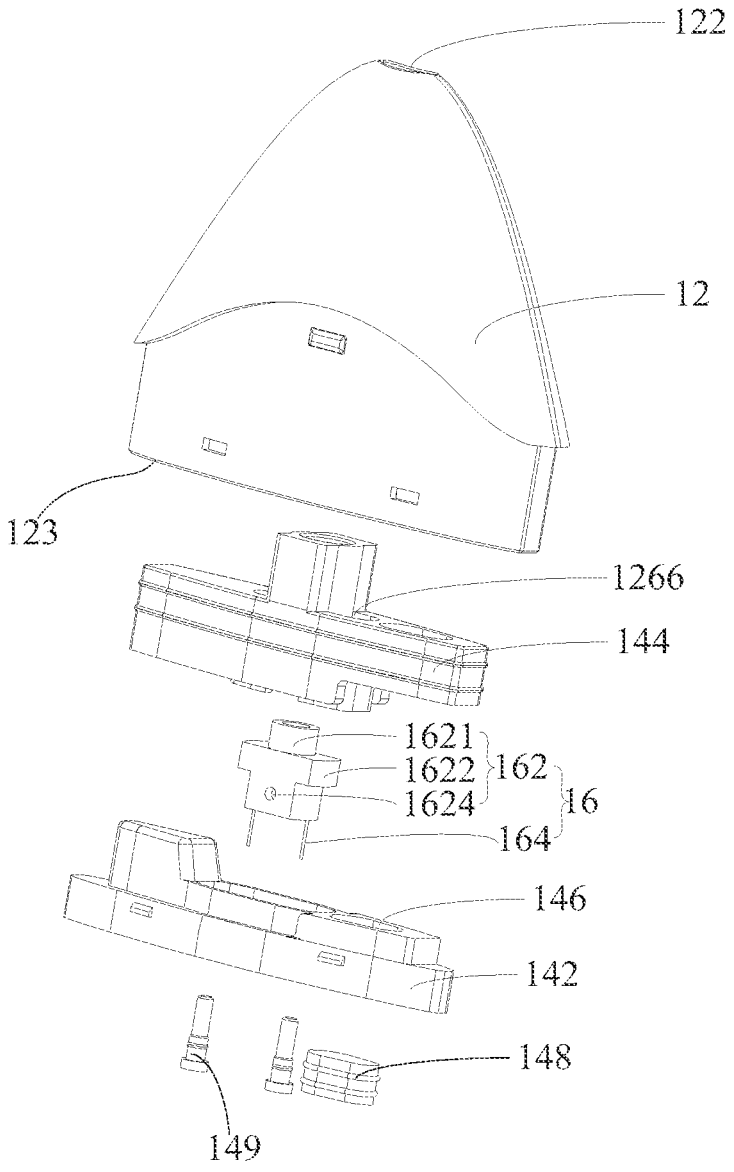
FIG. 3 is a schematic exploded view of the atomizer in FIG. 1.

Specifically, referring to FIGS. 2 and 3, the atomizer 10 includes a housing 12, a base 14, and an atomization component 16. The housing includes a mouthpiece end 122 and an opening end 123. The base 14 is plugged into the opening end 123 of the housing 12. An e-liquid storage chamber 124 and an airflow channel 126 are provided inside the housing 12. The atomization component 16 includes a porous heating element. The porous heating element includes a porous element 162 and a heating element 164 provided in the porous element 162. The porous element 162 is provided inside the airflow channel 126, and the porous element 162 includes a porous body 1621 and a porous boss 1622 protruding from the porous body 1621 and extending radially along the porous body 1621. The porous boss 1622 is in communication with the e-liquid storage chamber 124 through the airflow channel 126. That is, the porous boss 1622 radially provided on a side of the porous element 162 is in direct contact with the e-liquid. The e-liquid in the e-liquid storage chamber 124 can be exported to the inside of the porous element 162 because of an e-liquid guiding function and an e-liquid locking function of the porous element 162. After being powered on, the heating element 164 provided in the porous element 162 heats up and atomizes the e-liquid locked in the porous element 162 to form smoke for the user to take. The design of the porous heating element can simplify an internal structure of the atomizer 10, without further providing another e-liquid guiding cotton element for ensuring an e-liquid guiding effect.

In an embodiment, an e-liquid guiding hole 1266 is provided in a wall surface between the e-liquid storage chamber 124 and the airflow channel 126. The porous boss 1622 passes through the e-liquid guiding hole 1266 and is in direct contact with the e-liquid storage chamber 124. There is an interference fit between the porous boss 1622 and the e-liquid guiding hole 1266.

In an embodiment, the porous body 1621 has a hollow chamber structure with one end open and the other end closed, and the closed end of the porous body 1621 is adjacent to the base 14. The porous body 1621 is beneficial to collect the liquor condensate and prevent the liquor condensate from leaking out of a bottom portion of the porous body 1621. The porous body 1621 is also beneficial to the secondary atomization of the liquor condensate and prevent the liquor condensate from leaking out of the base 14, thereby improving the taste of the smoke and the safety and reliability of the electronic cigarette. A side wall of the porous body 1621 is provided with a through hole 1624. The through hole 1624 directs air into the atomizer 10 and then into the atomization component 16 through the through hole 1624, to provide air required for the high-temperature atomization.

An outer wall of the porous element 162 is fitted to an inner wall of the airflow channel 126, such that the liquor condensate formed by atomizing the e-liquid at a high temperature accumulates at the porous heating element 164, so as to facilitate the secondary atomization and improve the taste of smoke. At the same time, the liquor condensate is prevented from leaking out of the base 14 and penetrating into the host 20, thereby effectively preventing the liquor condensate from corroding a circuit board, and effectively improving safety, reliability, and service life of the electronic cigarette.

In an embodiment, an outer wall of the porous body 1621 is partially fitted to the inner wall of the airflow channel 126. A gap is preset between the through hole 1624 and the inner wall of the airflow channel 126. That is, air may flow into the airflow channel 126 through the through hole 1624. The air flows through the through hole 1624, and an air intake hole 141 of the atomizer 10 is in communication with the mouthpiece 122 of the atomizer 10, accordingly, the air required for atomization is provided. Since one end of the porous element 162 away from the base 14 is fitted to the airflow channel 126, the air flows through the through hole 1624 into the hollow chamber and is atomized to form smoke for the user to take. The formed liquor condensate accumulates in the porous body 1621 or in the hollow chamber thereof, so as to facilitate the secondary atomization without leaking to the base 14.

The heating element 164 is attached to a hollow inner wall of the porous body 1621, or is embedded in the porous body 1621, which is beneficial for the heating element 164 to atomize when the porous element 162 adsorbs and locks a large amount of the e-liquid, thereby generating more smoke for the user to take, and producing full taste. An electrical contact portion 165 of the heating element 164 protrudes from the closed end of the porous element 162, so as to facilitate a connection between the heating element 164 and an electrode column 149 of the atomizer 10.

Specifically, the porous element 162 is a porous ceramic e-liquid guiding element, a porous glass e-liquid guiding element, or an e-liquid guiding element made of other materials.

In another embodiment, the porous boss 1622 of the porous element 162 may extend in a direction perpendicular to the airflow channel 126. A gap for to air to flow is formed between the porous body 1621 and the airflow channel 126. At the moment, the heating element 164 may be a printed circuit printed on the outer wall of the porous body 1621, and the printed circuit is electrically connected to an electrode column 149 provided in the atomizer 10.

In the present embodiment, the porous body 1621 and the porous boss 1622 are intersected, and a shape of an axial cross section of the porous element 162 is T-shaped, cross-shaped. L-shaped, or Y-shaped. That is, the porous element 162 at least includes a hollow chamber of the porous body 1621 which is in communication with the airflow channel 126 and a porous boss 1622 plugged into the e-liquid guiding hole 1266. The porous boss 1622 has positioning function and e-liquid exporting function.

In the present embodiment, the airflow channel 126 is provided in a middle portion inside the housing 12, and the airflow channel 126 is surrounded by the e-liquid storage chamber 124. At least two e-liquid guiding holes 1266 are symmetrically provided on a wall surface between the e-liquid storage chamber 124 and the airflow channel 126. The porous element 162 is accordingly provided with at least two porous bosses 1622 to plug in and close the e-liquid guiding holes 1266. The porous boss 1622 can direct the e-liquid into the porous element 162 for the heating element 164 to atomize at a high temperature. A symmetrical arrangement of the porous boss 1622 is advantageous to uniformity of the e-liquid guiding of each portion of the porous element 162 and uniformity of high-temperature atomization of the heating element, and is advantageous to balance formation of the smoke and heating portions, improve the taste of smoke, and improve the service life of the heating element 164.

In the present embodiment, the airflow channel 126 includes an atomization chamber 1262 and a smoke channel 1264 communicating with each other. The e-liquid guiding hole 1266 is provided on a wall surface of the atomization chamber 1262. The atomization component 16 is plugged into the e-liquid guiding hole 1266 via the porous boss 1622 and fixed in the atomization chamber 1262. The atomization chamber 1262 is in communication with the air intake hole 141 of the atomizer 10, and the smoke channel 1264 is in communication with a mouthpiece 122 of the atomizer 10.

In the present embodiment, the base 14 includes a supporting seat 142 and a sealing seat 144. The supporting seat 142 is sheathed in the sealing seat 144. The atomization chamber 1262 is provided between the supporting seat 142 and the sealing seat 144. The atomization chamber 1262 and the smoke channel 1264 run through the sealing seat 144 and communicate with each other. As for the arrangement of the supporting seat 142 and the sealing seat 144, on one hand, the atomization component 16 is mounted to the sealing seat 144 before the sealing seat 144 is mounted to the supporting seat 142, thereby simplifying the assembling process and improving the production efficiency; on the other hand, the sealing seat 144 may seal a gap between the e-liquid storage chamber 124 and the supporting seat 142, thereby avoiding leak of the e-liquid. In an embodiment, the sealing seat 144 is made of a silicone material, and there is an interference fit between the sealing seat 144 and a gap between the supporting seat 142 and the housing 12. There is also an interference fit between the porous boss 1622 and the e-liquid guiding hole 1266, thereby improving the sealing performance.

Figure 4:
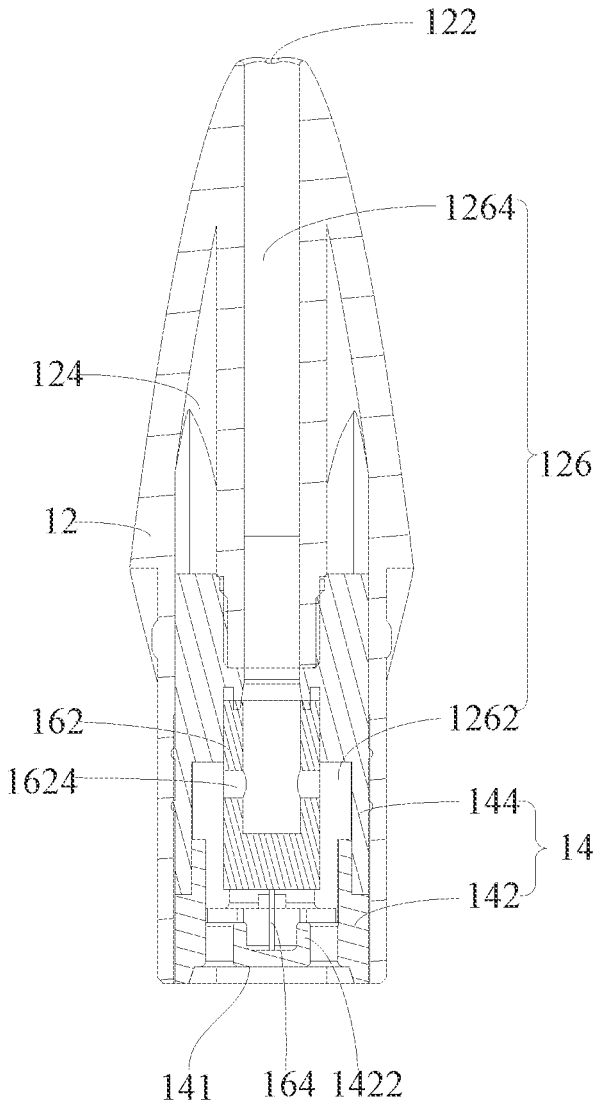
FIG. 4 is a cross-sectional view of the atomizer in FIG. 1 from another perspective.

Referring to FIG. 4, in the present embodiment, the air intake hole 141 of the atomizer 10 is provided in the base 14. The air intake hole 141 is in communication with the airflow channel 126. One side of the base 14 adjacent to the airflow channel 126 is provided with a weir 1422, and the air intake hole 141 is surrounded by the weir 1422, thereby the weir 1422 can further fervent the liquor condensate from leaking out of the base 14. That is, the atomizer 10 takes in air from a bottom portion. After the atomizer 10 is mounted to the host 20, a gap is formed between the housing 12 of the atomizer 10 and a casing of the host 20 to satisfy the requirements of air intake, or an air intake groove can be provided on an outer wall of the housing 12 of the atomizer 10. Apparently, in other embodiments, the air intake hole 141 of the atomizer 10 may further be provided on the housing 12, as long as the air intake hole 141 is in communication with the atomization chamber 1262.

Referring to FIGS. 2 and 3, in the present embodiment, the base 14 is provided with an e-liquid injection hole 146 and an e-liquid injection plug 148. The e-liquid injection hole 146 is in communication with the e-liquid storage chamber 124, and the e-liquid injection plug 148 is adapted to the e-liquid injection hole 146. The e-liquid can be injected into the e-liquid storage chamber 124 through the e-liquid injection hole 146. After the e-liquid in the atomizer 10 is used up, the e-liquid storage chamber 124 can be filled with e-liquid through the e-liquid injection hole 146, which facilitates multiple reuse of the atomizer 10 and reduces a consumption cost of the user. Apparently, instead of providing the e-liquid injection hole 146 and the e-liquid injection plug 148, the atomizer 10 can also be made into a closed type. That is, the e-liquid is injected during production before the base 14 and the housing 12 are assembled and sealed; and the atomizer 10 is replaced with a new one when the e-liquid is used up, which is beneficial to ensure hygiene of the e-liquid.

Figure 5:
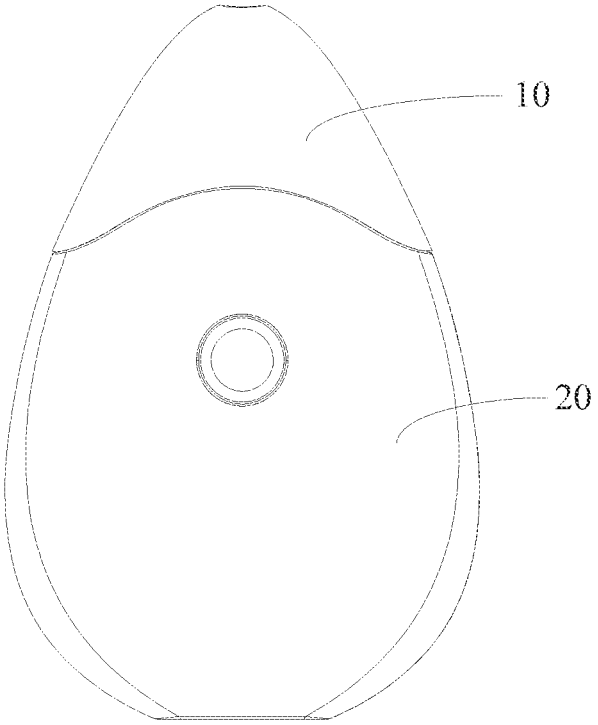
FIG. 5 is a schematic structure diagram of an electronic cigarette according to an embodiment.

Referring to FIG. 5, the present disclosure also provides an electronic cigarette including an atomizer 10 and a host 20. A specific structure of the atomizer 10 can be understood with reference to the above embodiment. Since the electronic cigarette employs all the technical solutions of all the above embodiments, the electronic cigarette at least has all the advantages of the technical solution of the above embodiments, which are not repeated here. The atomizer 10 is electrically conductive with to the host 20, and the atomizer 10 is plugged into the host 20. The atomizer 10 and the host 20 can be provided with a magnetic component or a snap component, such that the atomizer 10 is plugged into the host 20 through the magnetic component or the snap component. When the electronic cigarette is used, the atomizer 10 and the host 20 are assembled, and the electronic cigarette can be smoked by inhaling at the mouthpiece 122. A detachable plug-assembly structure between the atomizer 10 and the host 20 allows for free replacement of the host 20 and the atomizer 10, in other words, if one of the host 20 and the atomizer 10 is not available, the one which is not available can be replaced with a new one, thereby saving the use cost.

Figure 6:
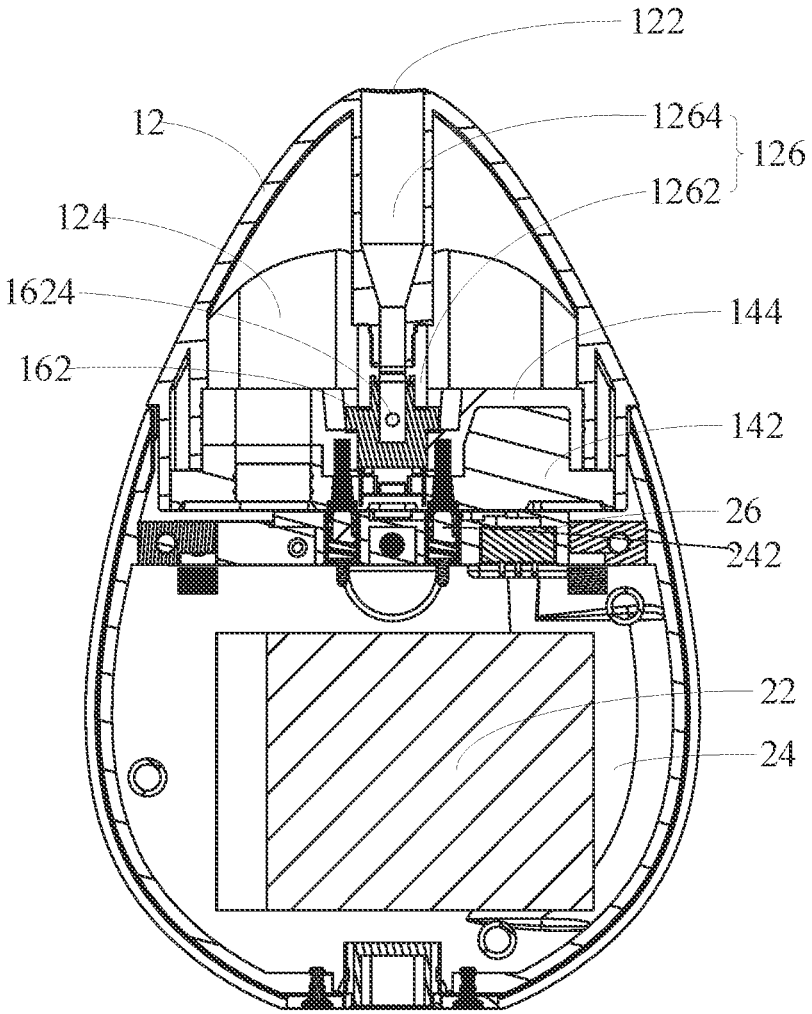
FIG. 6 is a cross-sectional view of the electronic cigarette in FIG. 5.

Specifically, referring to FIG. 6, the host 20 is a control center of the electronic cigarette. The host 20 includes a housing, a support, a battery 22, a main control board 24 and an air pressure switch 26. The support, the battery 22, the main control board 24 and the air pressure switch 26 are all provided inside of the housing. The support is fitted and fixed to an inner wall of the housing. A corresponding mounting part may be provided, such as, a mounting groove of the battery 22, a mounting groove of the main control board 24, and a mounting groove of the air pressure switch 26 etc. The air pressure switch 26 is in communication with the airflow channel 126. When inhaling at the mouthpiece 122, a negative pressure can be formed at the air pressure switch 26 and the air pressure switch 26 is triggered to turn on. The battery 22, the main control board 24, and the air pressure switch 26 are electrically connected to each other. The main control board 24 is provided with a conductive column 242 protruding from an assembly end of the main unit 20 and the atomizer 10. Accordingly, the conductive column 242 of the host 20 is in contact with the electrode column 149 of the atomizer 10 when the atomizer 10 is plugged into the host 20, thereby implementing an electrical connection. When powered on, the heating element 164 in the atomizer 10 can heat and atomize the e-liquid.

The above-mentioned atomizer 10 and electronic cigarette at least include the following advantages.

The atomization component 16 of the atomizer 10 can be directly plugged into and fixed to the base 14, and the atomization component 16 can be directly plugged into the e-liquid guiding hole 1266 to contact the e-liquid in the e-liquid storage chamber 124, thereby omitting a process of covering the atomizer 10 with cotton, and thus having simple and quick assembly, and saving a cost. In addition, the atomization component 16 is provided to fit an inner wall of the airflow channel 126. The atomization component 16 is powered on to heat and atomize the e-liquid to form smoke. The liquor condensate formed is attached to wall surfaces of the smoke channel 1264 and the porous element 162. When there are more liquor condensates, the liquor condensates are adsorbed to the porous element 162. Since a bottom portion of the porous element 162 is sealed, the liquor condensate can be atomized a second time, thereby avoiding smoking the liquor condensate, and having good taste and good user experience. At the same time, the liquor condensate cannot leak out of the base 14 and penetrate into the host 20, thereby effectively preventing the liquor condensate from penetrating into the host 20 to corrode the circuit board, and effectively improving safety, reliability, and service life of the electronic cigarette.

The various technical features of the above-described embodiments can be arbitrarily combined. For the sake of brevity of description, all possible combinations of the various technical features in the above-described embodiments are not described, however, as long as there is no contradiction in the combinations of these technical features, the combinations should be deemed to be the scope of the disclosure.

The above-described embodiments represent only several exemplary embodiments of the disclosure. The description of the embodiments is more specific and detailed, but are not therefore to be construed as limiting the scope of the disclosure. It should be noted that several modifications and improvements can be made by those of ordinary skill in the art without departing from the inventive concept, all of the modifications and improvements fall within the scope of the disclosure. Therefore, the scope of protection of the disclosure shall be subject to the appended claims.

What is claimed is:

1. An atomizer, comprising a housing, a base and an atomization component, the housing comprising a mouthpiece end and an opening end, the base being plugged into the opening end of the housing, an electronic cigarette liquid (e-liquid) storage chamber and an airflow channel being provided inside the housing, wherein the atomization component comprises a porous heating element, the porous heating element comprises a porous element and a heating element provided in the porous element, the porous element is provided in the airflow channel, and the porous element comprises a porous body and a porous boss protruding from the porous body and extending radially along the porous body, the porous boss traverses the airflow channel and is in communication with the e-liquid storage chamber;

wherein the porous body has a hollow chamber structure with one end open and the other end closed, the closed end is adjacent to the base, a side wall of the porous body is provided with a through hole.

2. The atomizer according to claim 1 wherein an outer wall of the porous body is partially fitted to an inner wall of the airflow channel, a gap is preset between the through hole and the inner wall of the airflow channel.

3. The atomizer according to claim 2, wherein the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

4. The atomizer according to claim 2, wherein the base is provided with an e-liquid injection hole and an e-liquid injection plug, the e-liquid injection plug is adapted to the e-liquid injection hole, and the e-liquid injection hole is in communication with the e-liquid storage chamber.

5. The atomizer according to claim 1, wherein the porous body and the porous boss are intersected, and an axial cross section of the porous element is T-shaped, cross-shaped, L-shaped, or Y-shaped.

6. The atomizer according to claim 5, wherein the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

7. The atomizer according to claim 5, wherein the base is provided with an e-liquid injection hole and an e-liquid injection plug, the e-liquid injection plug is adapted to the e-liquid injection hole, and the e-liquid injection hole is in communication with the e-liquid storage chamber.

8. The atomizer according to claim 1, wherein a position relationship between the heating element and the porous body is any one of the following:

(1) the heating element is attached to a hollow inner wall of the porous body, and an electrical contact portion of the heating element protrudes from a closed end of the porous body;

(2) the heating element is a printed circuit printed on an outer wall of the porous body, and the printed circuit is electrically connected to an electrode column of the atomizer;

(3) the heating element is embedded in the porous body, and the electrical contact portion of the heating element protrudes from the closed end of the porous body.

9. The atomizer according to claim 8, wherein the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

10. The atomizer according to claim 1, wherein the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

11. The atomizer according to claim 10, wherein the airflow channel comprises an atomization chamber and a smoke channel which are in communication with each other, the e-liquid guiding hole is provided on a wall surface of the atomization chamber, and the atomization component is plugged into the e-liquid guiding hole via the porous boss and is fixed in the atomization chamber; the atomization chamber is in communication with an air intake hole of the atomizer, and the smoke channel is in communication with the mouthpiece of the atomizer.

12. The atomizer according to claim 11, wherein the base comprises a supporting seat and a sealing seat, the supporting seat is sheathed in the sealing seat, and the atomization chamber is provided between the supporting seat and the sealing seat, the atomization chamber and the smoke channel run through the sealing seat and are in communication with each other.

13. The atomizer according to claim 12, wherein the air intake hole of the atomizer is provided in the base, the air intake hole is in communication with the airflow channel, and one side of the base adjacent to the airflow channel is provided with a weir, the air intake hole is surrounded by the weir.

14. The atomizer according to claim 12, wherein the air intake hole of the atomizer is provided in the housing, the air intake hole is in communication with the airflow channel.

15. The atomizer according to claim 1, wherein the base is provided with an e-liquid injection hole and an e-liquid injection plug, the e-liquid injection plug is adapted to the e-liquid injection hole, and the e-liquid injection hole is in communication with the e-liquid storage chamber.

16. An electronic cigarette, comprising a host and the atomizer according to claim 1, wherein the atomizer is electrically conductive with the host, and the atomizer is plugged into the host.

17. The electronic cigarette according to claim 16, wherein the host comprises a battery, a main control board and an air pressure switch; the battery, the main control board and the air pressure switch are electrically connected with each other; the air pressure switch is in communication with the airflow channel, and the main control board is provided with a conductive column electrically connected to the atomizer.

18. The atomizer according to claim 1, wherein the airflow channel is provided in a middle portion inside the housing, the airflow channel is surrounded by the e-liquid storage chamber, and at least two e-liquid guiding holes are symmetrically provided on a wall surface between the e-liquid storage chamber and the airflow channel; the porous element is correspondingly provided with at least two porous bosses to plug into and close the e-liquid guiding holes.

19. The atomizer according to claim 1, wherein the base is provided with an e-liquid injection hole and an e-liquid injection plug, the e-liquid injection plug is adapted to the e-liquid injection hole, and the e-liquid injection hole is in communication with the e-liquid storage chamber.

* * * * *